US010538874B2

(12) United States Patent
Lu et al.

(10) Patent No.: US 10,538,874 B2
(45) Date of Patent: Jan. 21, 2020

(54) HEAT PUMP MOUNTING BOX AND HEAT PUMP DRYER OR HEAT PUMP WASHER-DRYER

(71) Applicant: WUXI LITTLE SWAN CO., LTD., Wuxi (CN)

(72) Inventors: Song Lu, Wuxi (CN); Yulai Miao, Wuxi (CN); Wei Qian, Wuxi (CN)

(73) Assignee: WUXI LITTLE SWAN CO., LTD., Wuxi (CN)

( * ) Notice: Subject to any disclaimer, the term of this patent is extended or adjusted under 35 U.S.C. 154(b) by 402 days.

(21) Appl. No.: 15/382,867

(22) Filed: Dec. 19, 2016

(65) Prior Publication Data

US 2017/0342645 A1 Nov. 30, 2017

(30) Foreign Application Priority Data

May 31, 2016 (CN) ..... 2016 1 0377484
May 31, 2016 (CN) ..... 2016 2 0519143 U

(51) Int. Cl.
*D06F 58/20* (2006.01)
*D06F 29/02* (2006.01)
*D06F 39/04* (2006.01)

(52) U.S. Cl.
CPC ..... *D06F 58/206* (2013.01); *D06F 29/02* (2013.01); *D06F 39/04* (2013.01)

(58) Field of Classification Search
CPC ..... D06F 58/206; D06F 29/02; D06F 58/22; D06F 39/04; D06F 25/00; D06F 58/20
See application file for complete search history.

(56) References Cited

U.S. PATENT DOCUMENTS

2010/0107703 A1* 5/2010 Hisano ..... D06F 25/00 68/20

FOREIGN PATENT DOCUMENTS

| | | | |
|---|---|---|---|
| CN | 201416109 | Y | 3/2010 |
| CN | 102686792 | A | 9/2012 |
| CN | 103422332 | A | 12/2013 |
| CN | 204023254 | U | 12/2014 |

(Continued)

OTHER PUBLICATIONS

First Office Action, CN201610377484.0, dated Jun. 20, 2017, 15 pgs.

(Continued)

*Primary Examiner* — Jessica Yuen
(74) *Attorney, Agent, or Firm* — Morgan, Lewis & Bockius LLP

(57) ABSTRACT

A heat pump mounting box for a heat pump dryer or washer-dryer, and a heat pump dryer or washer-dryer having the same are provided. The heat pump mounting box includes a base provided with an air suction port and a two-device mounting chamber; an air passage guide plate mounted on the base and defining, together with the base, an air guide passage that has a drying air inlet in communication with the air suction port and a drying air outlet in communication with the two-device mounting chamber; and a flock filter mesh assembly drawably mounted on at least one of the base and the air passage guide plate and located at the drying air outlet. The heat pump mounting box according to the present invention has good connection tightness and is easy to clean, thereby being less likely to cause air quantity loss and flock accumulation.

14 Claims, 2 Drawing Sheets

(56) References Cited

FOREIGN PATENT DOCUMENTS

| | | | | |
|---|---|---|---|---|
| CN | 104420144 | A | 3/2015 | |
| CN | 105483969 | A | 4/2016 | |
| CN | 105544162 | A | 5/2016 | |
| JP | 3849713 | B2 | 11/2006 | |
| JP | 2009125453 | A | 6/2009 | |
| JP | 2014025670 | A | 2/2014 | |
| WO | WO2014/116001 | A1 | 7/2014 | |
| WO | WO-2015139966 | A1 * | 9/2015 | ..... D06F 58/24 |

OTHER PUBLICATIONS

Office Action, CN201610377484.0, dated Mar. 5, 2018, 6 pgs.
Wuxi Little Swan Co. Ltd., International Search Report, PCT/CN2016/087126, dated Mar. 1, 2017, 13 pgs.
Wuxi Little Swan Co. Ltd., Extended European Search Report, EP17150223.0, dated May 15, 2017, 8 pgs.
First Office Action, CN201610377782.X, dated Aug. 1, 2019, 10 pgs.

* cited by examiner

HEAT PUMP MOUNTING BOX AND HEAT PUMP DRYER OR HEAT PUMP WASHER-DRYER

CROSS-REFERENCE TO RELATED APPLICATION

This application claims priority to and benefits of Chinese Patent Application Serial No. 201610377484.0 and Chinese Patent Application Serial No. 201620519143.8, both of which were filed with the State Intellectual Property Office of P. R. China on May 31, 2016, the entire contents of which are incorporated herein by reference.

FIELD

The present invention relates to a field of washing equipment, and more particularly to a heat pump mounting box for a heat pump dryer or washer-dryer, and a heat pump dryer or washer-dryer having the same.

BACKGROUND

For a heat pump dryer or washer-dryer in the related art, a flock filter unit in a heat pump mounting box thereof includes an air guide structure and a flock filter mesh. However, due to a drawable design of the air guide structure, the sealability of connections between the flock filter unit and a drying air inlet and between the flock filter unit and a drying air outlet of a two-device mounting chamber is poor, such that drying air loss is caused and the lost drying air will form condensate water in the flock filter unit; moreover, the flock filter unit is not easy to clean since it is fixed on the air guide structure, thereby resulting in a serious flock accumulation phenomenon.

SUMMARY

The present invention aims to solve at least one of the problems existing in the related art. Thus, embodiments of the present invention provide a heat pump mounting box for a heat pump dryer or washer-dryer that has advantages of good connection tightness and easiness of cleaning.

Embodiments of the present invention further provide a heat pump dryer or washer-dryer having the heat pump mounting box.

According to embodiments of a first aspect of the present invention, the heat pump mounting box includes a base provided with an air suction port and a two-device mounting chamber; an air passage guide plate mounted to the base and defining, together with the base, an air guide passage that has a drying air inlet in communication with the air suction port and a drying air outlet in communication with the two-device mounting chamber; and a flock filter mesh assembly for intercepting flock in drying air blown to the two-device mounting chamber, drawably mounted to at least one of the base and the air passage guide plate, and located at the drying air outlet.

In the heat pump mounting box according to the embodiments of the present invention, on one hand, the air passage guide plate is mounted on the base and defines, together with the base, the air guide passage that is in direct communication with the drying air inlet and the drying air outlet; on the other hand, the flock filter mesh assembly is drawably mounted to at least one of the base and the air passage guide plate, such that the heat pump mounting box enjoys good connection tightness and is easy to clean, thereby being less likely to cause air quantity loss and flock accumulation.

Moreover, the heat pump mounting box according to the present invention has the following additional technical features.

According to some embodiments of the present invention, the air guide passage is provided with several shaping guide ribs therein that extend from the drying air inlet to the drying air outlet in a length direction of the air guide passage and is connected to the base or the air passage guide plate.

According to some embodiments of the present invention, the drying air inlet is disposed in the air passage guide plate, and the drying air outlet is disposed in the air passage guide plate and has a lower edge constituted by the base.

Further, a drawable guide rail is provided to at least one of the air passage guide plate and the base, and the flock filter mesh assembly is slidably fitted in the drawable guide rail.

Alternatively, the drawable guide rail includes a vertical groove segment disposed at an inner edge of the drying air outlet, a horizontal groove segment disposed an upper edge thereof, and a drawable port disposed at an outer edge thereof.

According to some embodiments of the present invention, the heat pump mounting box further includes an air suction bellow disposed within the base, the air passage guide plate is provided with an air inlet sealing turn-up surrounding the drying air inlet, and the air suction bellow has a first end in communication with the air suction port, and a second end fitted over the air inlet sealing turn-up and in communication with the drying air inlet.

According to some embodiments of the present invention, the heat pump mounting box further includes a cover plate mounted over the base and at least covering the two-device mounting chamber, and the air passage guide plate is provided with an air outlet sealing turn-up that surrounds the drying air outlet and is pressed tight by the cover plate.

According to some embodiments of the present invention, the two-device mounting chamber includes an evaporator mounting section and a condenser mounting section communicated with each other, and the drying air outlet is in communication with the evaporator mounting section.

According to some embodiments of the present invention, the flock filter mesh assembly includes a support frame drawably mounted at the drying air outlet, and a filter mesh disposed in the support frame.

According to embodiments of a second aspect of the present invention, the heat pump dryer or washer-dryer includes the heat pump mounting box according to the embodiments of the first aspect of the present invention.

The heat pump dryer or washer-dryer according to the present invention employs the heat pump mounting box described above, such that it is less possible to lose the drying air and accumulate flock, so as to achieve excellent clothes drying performance and facilitate componentization and modularization of production and installation.

Additional aspects and advantages of embodiments of present invention will be given in part in the following descriptions, become apparent in part from the following descriptions, or be learned from the practice of the embodiments of the present invention.

Figure 1:
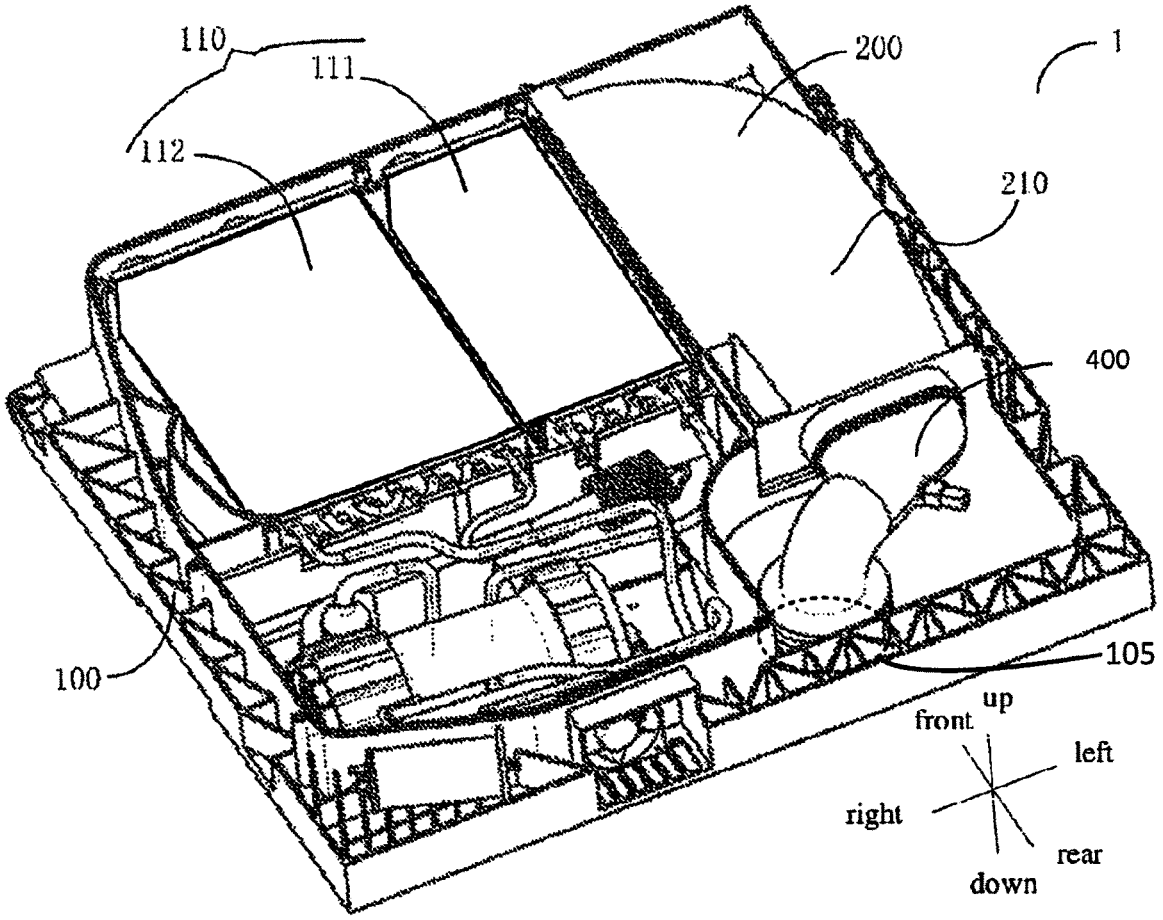
FIG. 1 is a perspective view of a heat pump mounting box for a heat pump dryer or washer-dryer according to an embodiment of the present invention.

REFERENCE NUMERALS heat pump mounting box 1, base 100, two-device mounting chamber 110, evaporator mounting section 111, condenser mounting section 112, air passage guide plate 200, air guide passage 210, drying air inlet 211, drying air outlet 212, shaping guide rib 220, drawable guide rail 230, vertical groove segment 231, horizontal groove segment 232, drawable port 233, air inlet sealing turn-up 240, air outlet sealing turn-up 250, flock filter mesh assembly 300, support frame 310, handle 311, filter mesh 320, air suction bellow 400.

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

In the following, a heat pump mounting box 1 for a heat pump dryer or washer-dryer according to embodiments of a first aspect of the present invention will be described with reference to FIGS. 1 to 3. The heat pump mounting box 1 is suitable for an integrated pre-installed heat pump drying system, and may be disposed at the top of the heat pump dryer or washer-dryer, which is beneficial to componentizing and modularizing production and installation and has the advantages of good connection tightness and easiness of cleaning.

Figure 2:
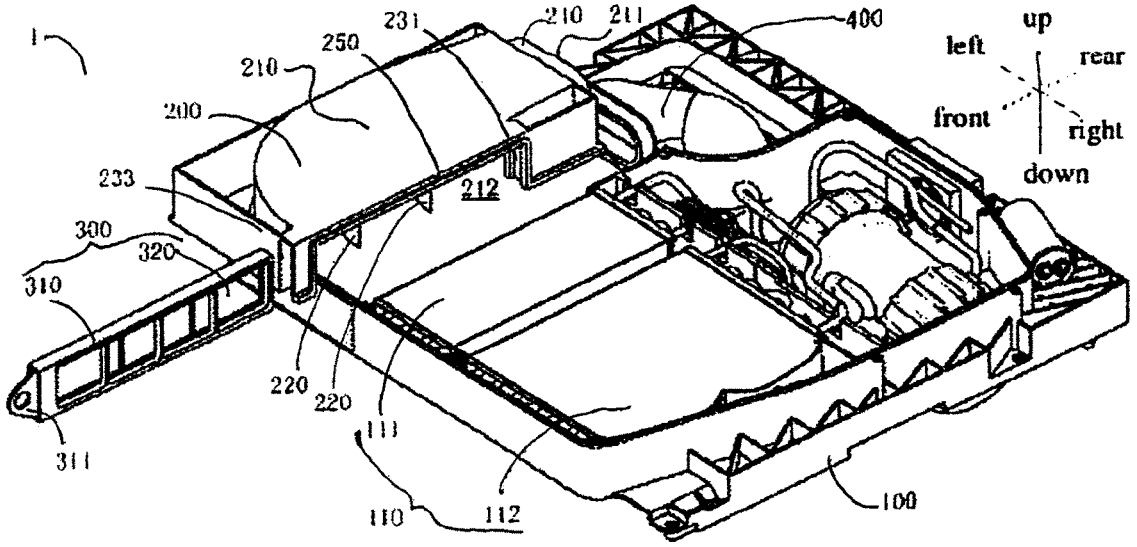
FIG. 2 is another perspective view of the heat pump mounting box according to the embodiment of the present invention.
Figure 3:
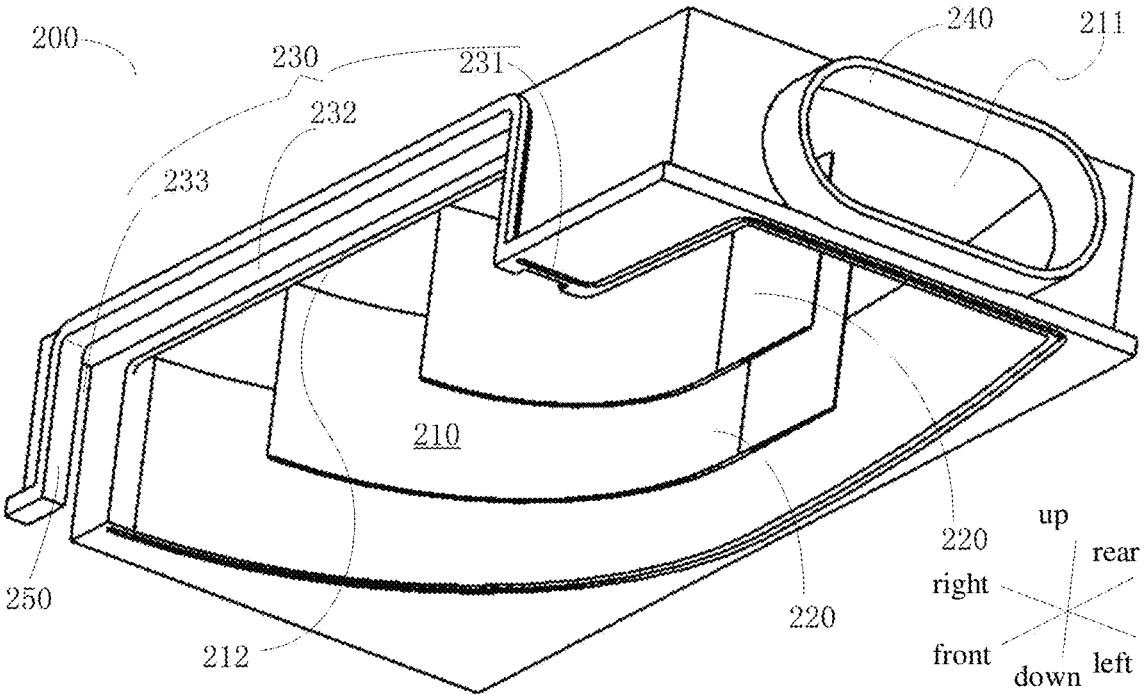
FIG. 3 is a schematic view of an air passage guide plate of the heat pump mounting box according to the embodiment of the present invention.

As shown in FIGS. 1 to 3, the heat pump mounting box 1 according to the embodiments of the present invention includes a base 100, an air passage guide plate 200, and a flock filter mesh assembly 300.

Specifically, the base 100 is provided with an air suction port 105 (dashed line indicating non-visibility from the current view) and a two-device mounting chamber 110. The air passage guide plate 200 is mounted to the base 100 and defines, together with the base 100, an air guide passage 210 that has a drying air inlet 211 in communication with the air suction port 105 and a drying air outlet 212 in communication with the two-device mounting chamber 110. In FIGS. 1 and 2, an outer top wall of the air passage guide plate 200 represents the air guide passage 210. The flock filter mesh assembly 300 is drawably mounted to at least one of the base 100 and the air passage guide plate 200, and located at the drying air outlet 212, so as to intercept flock in drying air blown to the two-device mounting chamber 110.

It may be understood that the term "two-device" in "the two-device mounting chamber 110" refers to an evaporator and a condenser that constitute the heat pump drying system, and the evaporator and the condenser are mounted within the two-device mounting chamber 110 separately. It can also be understood that the heat pump drying system may further include a compressor, a throttling device, a fan, a sealing member and a damping member.

It shall be noted that the air passage guide plate 200 may be fixed to the base 100 via a fastener, like a screw, or may employ snap connection with the base 100, or may be hot-melted on the base 100. The description that the flock filter mesh assembly 300 is drawably mounted to at least one of the base 100 and the air passage guide plate 200 includes the following three cases: the flock filter mesh assembly 300 being drawably mounted to the base 100; the flock filter mesh assembly 300 being drawably mounted to the air passage guide plate 200; and the flock filter mesh assembly 300 being drawably mounted to both of the base 100 and the air passage guide plate 200.

Consequently, on one hand, the air guide passage 210 is in direct communication with the drying air inlet 211 and the drying air outlet 212, so all the drying air may fully enter the air guide passage 210 via the air suction port 105, then enter the two-device mounting chamber 110 via the drying air outlet 212 after interception and filtration of the flock filter mesh assembly 300, and finally exchange heat with the evaporator and the condenser in the two-device mounting chamber 110, so as to avoid the drying air loss and the formation of condensate water in the air guide passage 210; on the other hand, the flock filter mesh assembly 300 may be conveniently drawn out for cleaning, since it may be separately drawn out from at least one of the base 100 and the air passage guide plate 200, which can avoid the flock accumulation and leakage.

In conclusion, for the heat pump mounting box 1 according to the embodiments of the present invention, on one hand, the air passage guide plate 200 is mounted to the base 100 and defines, together with the base 100, the air guide passage 210 that is in direct communication with the drying air inlet 211 and the drying air outlet 212; on the other hand, the flock filter mesh assembly 300 is drawably mounted to at least one of the base 100 and the air passage guide plate 200, such that the heat pump mounting box 1 enjoys good connection tightness and is easy to clean, thereby being less likely to cause air quantity loss and flock accumulation.

In some embodiments of the present invention, as shown in FIGS. 2 and 3, the air guide passage 210 may be provided with several shaping guide ribs 220 (rids for guiding the air direction to make the air flow along the ribs) therein that extend from the drying air inlet 211 to the drying air outlet 212 in a length direction of the air guide passage 210 and are connected to the base 100 or the air passage guide plate 200, such that the drying air can only flow from the drying air inlet 211 to the drying air outlet 212 along the shaping guide ribs 220, so as to shape and guide the drying air flow in the air guide passage 210 and enhance the sealability of the air guide passage 210, and moreover, the drying air may flow into the two-device mounting chamber 110 evenly. Herein, the term "several shaping guide ribs 220" includes two situations, namely, one shaping guide rib 220 and a plurality of shaping guide ribs 220. For example, the length direction of the air guide passage 210 is parallel to the front-and-rear direction, a central axis of the drying air inlet 211 extends along the front-and-rear direction while that of the drying air outlet 212 extends along the left-and-right direction, and two shaping guide ribs 220 are provided, each of which extends from rear to front and is bent rightwards.

In the embodiment shown in FIGS. 1 to 3, the drying air inlet 211 is disposed in the air passage guide plate 200, and the drying air outlet 212 is disposed in the air passage guide plate 200 and has a lower edge constituted by the base 100, so as to achieve good sealability of the air guide passage 210 and facilitate the installation of the flock filter mesh assembly 300.

Further, as shown in FIGS. 2 and 3, a drawable guide rail 230 is provided to at least one of the air passage guide plate 200 and the base 100, and the flock filter mesh assembly 300 is slidably fitted in the drawable guide rail 230, such that the flock filter mesh assembly 300 may be withdrawn smoothly. For example, the drawable guide rail 230 is disposed on the air passage guide plate 200, and the flock filter mesh assembly 300 may be drawably mounted on the air passage guide plate 200.

Alternatively, as shown in FIGS. 2 and 3, the drawable guide rail 230 may include a vertical groove segment 231 disposed at an inner edge of the drying air outlet 212 (e.g. a rear edge of the drying air outlet 212 in the drawings), a horizontal groove segment 232 disposed an upper edge thereof, and a drawable port 233 disposed at an outer edge thereof (e.g. a front edge of the drying air outlet 212 in the drawings). Therefore, a user may insert the flock filter mesh assembly 300 into the horizontal groove segment 232 from the front side of the drying air outlet 212, and push the flock filter mesh assembly 300 backwards into the vertical groove segment 231, so as to complete the installation of the flock filter mesh assembly 300; when the flock filter mesh assembly 300 needs to be withdrawn, the user may hold and pull the flock filter mesh assembly 300 frontwards.

According to some embodiments of the present invention, as shown in FIG. 2, the flock filter mesh assembly 300 may include a support frame 310 drawably mounted at the drying air outlet 212, and a filter mesh 320 disposed in the support frame 310. Preferably, the support frame 310 may be provided with a handle 311 to make it convenient for the user to withdraw the flock filter mesh assembly 300.

According to some embodiments of the present invention, as shown in FIGS. 1 to 3, the heat pump mounting box 1 further includes an air suction bellow 400 disposed within the base 100, the air passage guide plate 200 is provided with an air inlet sealing turn-up 240 surrounding the drying air inlet 211, and the air suction bellow 400 has a first end in communication with the air suction port 105, and a second end fitted over the air inlet sealing turn-up 240 and in communication with the drying air inlet 211. Thus, the sealability of the drying air inlet 211 may be enhanced to further avoid the leakage of the drying air, by fitting the second end of the air suction bellow 400 over the air inlet sealing turn-up 240.

In some embodiments of the present invention, as shown in FIGS. 2 and 3, the heat pump mounting box 1 further includes a cover plate (not shown) mounted over the base 100 and at least covering the two-device mounting chamber 110, and the air passage guide plate 200 is provided with an air outlet sealing turn-up 250 that surrounds the drying air outlet 212 and is pressed tight by the cover plate, so as to achieve good sealability of the drying air outlet 212. For example, the air outlet sealing turn-up 250 substantially has a shape of a Chinese character "几", and shapes of corresponding edges of the cover plate match with the shape of the air outlet sealing turn-up 250, in which the cover plate may further extend leftwards to cover the air passage guide plate 200.

According to some embodiments of the present invention, as shown in FIGS. 1 and 2, the two-device mounting chamber 110 may include an evaporator mounting section 111 and a condenser mounting section 112 communicated with each other, and the drying air outlet 212 is in communication with the evaporator mounting section 111. Thus, the evaporator is mounted in the evaporator mounting section 111 and the condenser is mounted in the condenser mounting section 112, and the drying air in the air guide passage 210 may be first condensed by the evaporator and then heated by the condenser, so as to dry the clothes.

The heat pump mounting box 1 according to a specific embodiment of the present invention will be described in detail with reference to the drawings. It should be appreciated that the following description is only explanatory and shall not be construed to limit the present invention.

As shown in FIGS. 1 to 3, the heat pump mounting box 1 according to the embodiment of the present invention includes the base 100, the air passage guide plate 200, the flock filter mesh assembly 300, the air suction bellow 400 and the cover plate (not shown).

Specifically, the base 100 is provided with the air suction port 105 and the two-device mounting chamber 110 that includes the evaporator mounting section 111 and the condenser mounting section 112 communicated with each other and configured to mount the evaporator and the condenser respectively. The air passage guide plate 200 is mounted on the base 100 and defines, together with the base 100, the air guide passage 210 that has the drying air inlet 211 and the drying air outlet 212 and is provided with two shaping guide ribs 220 extending from rear to front and bent rightwards. The drying air inlet 211 and the drying air outlet 212 are both provided in the air passage guide plate 200; the central axis of the drying air inlet 211 extends along the front-and-rear direction, while that of the drying air outlet 212 extends along the left-and-right direction and its lower edge is constituted by the base 100; the two shaping guide ribs 220 are both connected to the air passage guide plate 200.

The air passage guide plate 200 is provided with the air inlet sealing turn-up 240 surrounding the drying air inlet 211 and the air outlet sealing turn-up 250 surrounding the drying air outlet 212. The first end of the air suction bellow 400 is in communication with the air suction port 105, and the second end thereof is fitted over the air inlet sealing turn-up 240 and in communication with the drying air inlet 211. The drying air inlet 211 is in communication with the evaporator mounting section 111. The air outlet sealing turn-up 250 substantially has a shape of the Chinese character "几", the cover plate is mounted over the base 100 and covers the two-device mounting chamber 110, and shapes of corresponding edges of the cover plate match with the shape of the air outlet sealing turn-up 250 to press the air outlet sealing turn-up 250 tight.

The flock filter mesh assembly 300 includes the support frame 310 provided with the handle 311, and the filter mesh 320 disposed in the support frame 310. The air passage guide plate 200 is further provided with the drawable guide rail 230, and the support frame 310 is slidably fitted in the drawable guide rail 230 and located at the drying air outlet 212. The drawable guide rail 230 includes the vertical groove segment 231 disposed at the rear edge of the drying air outlet 212, the horizontal groove segment 232 disposed the upper edge thereof, and the drawable port 233 disposed at the front edge of the drying air outlet 212.

Consequently, on one hand, the air passage guide plate 200 is fixedly mounted to the base 100 and defines, together with the base 100, the air guide passage 210, the second end of the air suction bellow 400 is fitted over the air inlet sealing turn-up 240, and the cover plate presses the air outlet sealing turn-up 250 tight, such that the air guide passage 210 is in direct communication with the drying air inlet 211 and the drying air outlet 212, so as to enhance the sealability at the drying air inlet 211 and the drying air outlet 212, avoid the leakage of the drying air and the formation of the condensate water in the air guide passage 210; on the other hand, the flock filter mesh assembly 300 may be conveniently withdrawn for cleaning, since it may be separately drawn out from the air passage guide plate 200, which can avoid the flock accumulation and leakage.

In conclusion, the heat pump mounting box 1 according to the embodiments of the present invention has good connection tightness and is convenient to clean, thereby being less likely to cause air quantity loss and flock accumulation.

The heat pump dryer or washer-dryer according to embodiments of a second aspect of the present invention includes the heat pump mounting box 1 according to the embodiments of the first aspect of the present invention.

The heat pump dryer or washer-dryer according to the present invention employs the heat pump mounting box 1 described above, such that it is not easy to lose the drying air and accumulate the flock, so as to enjoy the excellent clothes drying performance and facilitate componentization and modularization of production and installation.

The other configurations and operations of the heat pump dryer or washer-dryer according to the embodiments of the present invention are known to those skilled in the art, which will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These relative terms are for convenience of description and do not require that the present invention be constructed or operated in a particular orientation. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "some embodiments," "specific embodiments," "alternative embodiments," "an example," or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable. The scope of the present invention is defined by the claims or the like.

What is claimed is:

1. A heat pump mounting box for a heat pump dryer or washer-dryer, comprising:

a base provided with an air suction port and a two-device mounting chamber;

an air passage guide plate mounted to the base and defining, together with the base, an air guide passage that has a drying air inlet in communication with the air suction port and a drying air outlet in communication with the two-device mounting chamber; and a flock filter mesh assembly for intercepting flock in drying air blown to the two-device mounting chamber, drawably mounted to at least one of the base and the air passage guide plate, and located at the drying air outlet, wherein a drawable guide rail is provided to at least one of the air passage guide plate and the base, and the flock filter mesh assembly is slidably fitted in the drawable guide rail, and wherein the drawable guide rail comprises a vertical groove segment disposed at an inner edge of the drying air outlet, a horizontal groove segment disposed at an upper edge thereof, and a drawable port disposed at an outer edge thereof.

2. The heat pump mounting box according to claim 1, wherein the air guide passage is provided with several shaping guide ribs therein that extend from the drying air inlet to the drying air outlet in a length direction of the air guide passage and is connected to the base or the air passage guide plate.

3. The heat pump mounting box according to claim 1, wherein the drying air inlet is disposed in the air passage guide plate, and the drying air outlet is disposed in the air passage guide plate and has a lower edge constituted by the base.

4. The heat pump mounting box according to claim 1, further comprising an air suction bellow that is disposed within the base, and has a first end in communication with the air suction port, and a second end in communication with the drying air inlet and fitted over an air inlet sealing turn-up disposed to the air passage guide plate and surrounding the drying air inlet.

5. The heat pump mounting box according to claim 1, further comprising a cover plate mounted over the base and at least covering the two-device mounting chamber, and wherein the air passage guide plate is provided with an air outlet sealing turn-up that surrounds the drying air outlet and is pressed tight by the cover plate.

6. The heat pump mounting box according to claim 1, wherein the two-device mounting chamber comprises an evaporator mounting section and a condenser mounting section communicated with each other, and the drying air outlet is in communication with the evaporator mounting section.

7. The heat pump mounting box according to claim 1, wherein the flock filter mesh assembly comprises:

a support frame drawably mounted at the drying air outlet, and a filter mesh disposed in the support frame.

8. A heat pump dryer or washer-dryer, comprising a heat pump mounting box for the heat pump dryer or washer-dryer, wherein the heat pump mounting box comprises:

a base provided with an air suction port and a two-device mounting chamber;

an air passage guide plate mounted to the base and defining, together with the base, an air guide passage that has a drying air inlet in communication with the air suction port and a drying air outlet in communication with the two-device mounting chamber; and a flock filter mesh assembly for intercepting flock in drying air blown to the two-device mounting chamber, drawably mounted to at least one of the base and the air passage guide plate, and located at the drying air outlet, wherein a drawable guide rail is provided to at least one of the air passage guide plate and the base, and the flock filter mesh assembly is slidably fitted in the drawable guide rail, and wherein the drawable guide rail comprises a vertical groove segment disposed at an inner edge of the drying air outlet, a horizontal groove segment disposed at an upper edge thereof, and a drawable port disposed at an outer edge thereof.

9. The heat pump dryer or washer-dryer according to claim 8, wherein the air guide passage is provided with several shaping guide ribs therein that extend from the drying air inlet to the drying air outlet in a length direction of the air guide passage and is connected to the base or the air passage guide plate.

10. The heat pump dryer or washer-dryer according to claim 8, wherein the drying air inlet is disposed in the air passage guide plate, and the drying air outlet is disposed in the air passage guide plate and has a lower edge constituted by the base.

11. The heat pump dryer or washer-dryer according to claim 8, further comprising an air suction bellow that is disposed within the base, and has a first end in communication with the air suction port, and a second end in communication with the drying air inlet and fitted over an air inlet sealing turn-up disposed to the air passage guide plate and surrounding the drying air inlet.

12. The heat pump dryer or washer-dryer according to claim 8, further comprising a cover plate mounted over the base and at least covering the two-device mounting chamber, and wherein the air passage guide plate is provided with an air outlet sealing turn-up that surrounds the drying air outlet and is pressed tight by the cover plate.

13. The heat pump dryer or washer-dryer according to claim 8, wherein the two-device mounting chamber comprises an evaporator mounting section and a condenser mounting section communicated with each other, and the drying air outlet is in communication with the evaporator mounting section.

14. The heat pump dryer or washer-dryer according to claim 8, wherein the flock filter mesh assembly comprises:

a support frame drawably mounted at the drying air outlet, and a filter mesh disposed in the support frame.

* * * * *